US005917274A

United States Patent [19]

Youn et al.

[11] Patent Number: 5,917,274

[45] Date of Patent: Jun. 29, 1999

[54] MASK FRAME FOR CATHODE RAY TUBE HAVING RESISTANCE HOLES

[75] Inventors: Haesu Youn, Kyungju-si; Chulsu Hong, Ulsan-si, both of Rep. of Korea

[73] Assignee: Samsung Display Devices Co., Ltd., Kyungki-do, Rep. of Korea

[21] Appl. No.: 08/703,896

[22] Filed: Aug. 27, 1996

[30] Foreign Application Priority Data

Sep. 25, 1995 [KR] Rep. of Korea ..... 95-25988

[51] Int. Cl.[6] ..... H01J 29/80

[52] U.S. Cl. ..... 313/407; 313/402; 313/404

[58] Field of Search ..... 313/402, 403, 313/404, 405, 406, 407

[56] References Cited

U.S. PATENT DOCUMENTS 3,710,165 1/1973 Tsuneta et al. ..... 313/407

3,737,703 6/1973 Tsuneta et al. ..... 313/407

5,214,349 5/1993 Sakata et al. ..... 313/407

5,416,378 5/1995 Andrevski ..... 313/402

*Primary Examiner*—Sandra O'Shea

*Assistant Examiner*—Vip Patel

*Attorney, Agent, or Firm*—Christie, Parker & Hale, LLP

[57] ABSTRACT

In color cathode ray tubes, a magnetic field of mask frame corner parts is sensitive to changes in the earth's magnetic field, so resistance holes are drilled in corner parts of a mask frame to increase resistance and to decrease the strength of magnetism for preventing decline of calorimetric purity of screen corner parts. These resistance holes are able to advance degaussing efficiency, to disperse the earth's magnetic field to insert resistance parts on the corner parts, and a magnetic field of the inner corner parts of a mask frame is not affected by resistance holes.

6 Claims, 2 Drawing Sheets

MASK FRAME FOR CATHODE RAY TUBE HAVING RESISTANCE HOLES

BACKGROUND

This invention relates to a mask frame for a cathode ray tube and particularly to a mask frame which can reduce the affect of electron beam paths by an external magnetic field, and allows distinct color reproduction.

Especially, the mask frame reduces change in the paths of the electron beams and cuts down the amount of change in the magnetic field of the mask frame corner parts which is caused by changes in the exterior magnetic field such as the earth's magnetic field.

The prior art color cathode ray tube allows color reproduction and makes it so electron beams shot from an electron gun land precisely on phosphor material of three colors which is spread on the inner surface of a panel.

Generally, a color cathode ray tube is comprised of a bulb having a panel on which a shadow mask is disposed which is a means for color reproduction, a funnel disposed as a tending means to construct raster and control the electron beam passing the interior of the CRT, and a neck in which an electron gun is disposed.

The shadow mask is adhered by welding etc., to the mask frame, which is supported on a skirt portion of the panel through a bimetal spring. An inner shield, which protects electron beams from the earth's magnetic field, is adhered to the rear of the mask frame.

FIG. 2 is a sectional view showing the panel 2 part of the color cathode ray tube having a mask frame 4 inside the skirt part of the panel supported by being suspended by a bimetal spring 6.

A shadow mask 8, having formed a great number of slits and has basically an identical curvature with the inside of said panel 2, is adhered to the front part of the mask frame 4.

The mask frame is produced in a rectangular shape of constant width and a flange part 12 to attach the mask frame 4 to an inner shield 12, and provided toward the back of the mask frame.

That is, FIG. 3 shows a mask frame 4 which is manufactured using an aluminum alloy metal or by a metal with invar qualities.

A mask assembly with this type of structure is able to diminish any influence the paths of the electron beams might receive, and is able to isolate the earth's magnetic field by the inner shield 10 when electron beams go toward the panel.

Especially, such as described in FIG. 3, an extreme change in the magnetic field results in the inner corner part of the mask frame because the structure of the corner part, realized through the meeting of a long side part 16 of the mask frame with a short side part 14 is made in a complete plate body, and there is an increase in the area that leads to a decrease in resistance.

But in a mask frame assembly structured as in the above, because the vertical elements of the earth's magnetic field operate from top to bottom in the northern hemisphere and the level elements of the earth's magnetic field operate from right to left, the magnetic field formed in a corner part of the mask frame is changed by these vertical and level elements of the earth's magnetic field.

Particularly, while this change is most extreme at the mask frame corner part, as a screen corner part's display characteristics are reduced in quality, a phenomenon arises wherein there is more of a decline in colorimetric purity of the corner part of the display than in the central part.

The reason for this extreme change of magnetic field in the inside corner part of the mask frame is because when the earth's magnetic field flows from top to bottom, the path is changed by a long side of the mask frame, and as it follows a short side of the mask frame, the vertical elements of the earth's magnetic field come to flow diagonally in the corner part of the mask frame.

This flow in a diagonal path is known to affect the path of electron beams passing this area.

The present invention has been made to solve the above problems.

It is an object of the present invention to provide a mask frame for a cathode ray tube that improves the colorimetric purity of a screen corner part and minimizes changes in a magnetic field of a mask frame corner part caused by changes in the earth's magnetic field.

To achieve the above objective, in a color cathode ray tube having a shadow mask to allot electron beams to each phosphor material inside the panel, the mask frame for a cathode ray tube is provided to distinguish the forming of resistance holes to the corner part joining a long side of the mask frame with a short side thereof.

Said resistance holes are provided for the CRT mask frame the same number at each side.

Also, a plurality of said resistance holes are provided at a flange corner part of the mask frame.

BRIEF DESCRIPTION OF THE DRAWINGS

For a better understanding of the invention and to show how the same may be carried into effect, reference will now be made to the accompanying drawings that illustrate an embodiment of the invention, in which.

DESCRIPTION

Figure 1:
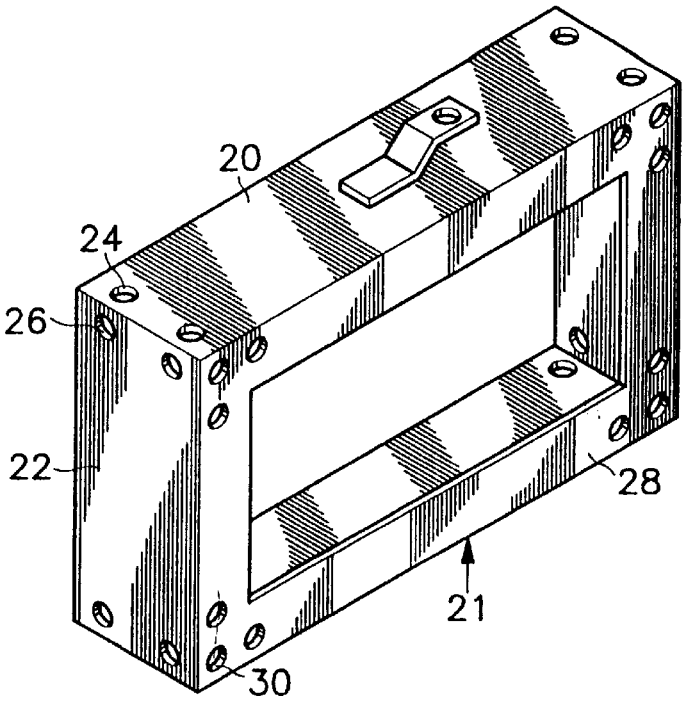
FIG. 1 is a perspective view showing a mask frame in accordance to a preferred embodiment of the invention.
Figure 2:
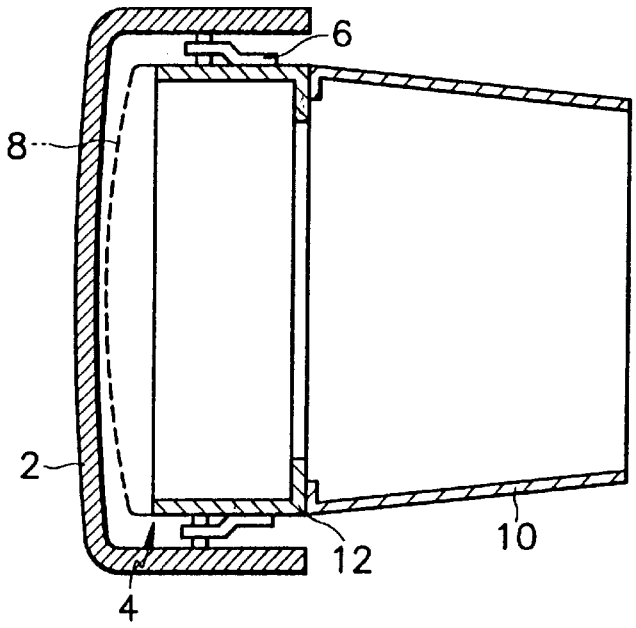
FIG. 2 PRIOR ART
FIG. 2 is a sectional side view showing the panel part of a conventional cathode ray tube.
Figure 3:
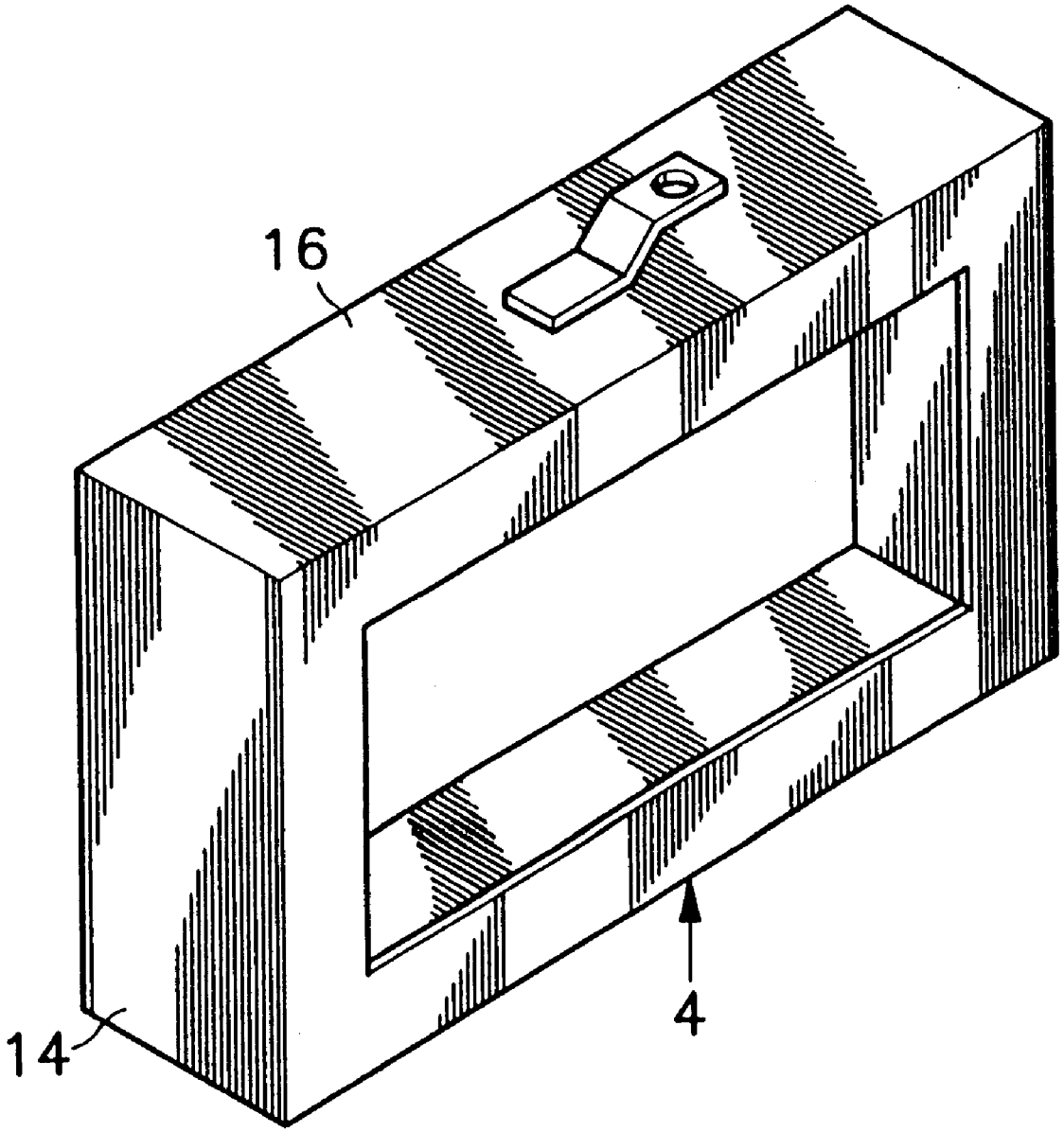
FIG. 3 PRIOR ART
FIG. 3 is a perspective view showing the prior art mask frame.

FIG. 1 shows a perspective view of a mask frame 21 of the present invention where a plurality of resistance holes 24 and 26 are located at each corner part realized through the joining of a long side 20 and a short side 22 of the mask frame.

And flange 28 corner parts of the frame also have a plurality of resistance holes.

In a preferred embodiment, because in the corner parts of the mask frame 21 there are formed a plurality of resistance holes that decrease the area, resistance is increased.

The resistance holes have a diameter of about 5.5 mm. Each of the long and short sides have two resistance holes and the four corner parts of the flange have three resistance holes.

Although the number of resistance holes is not limited to the above number, considering the size of the mask frames, this is an appropriate number.

This type of mask frame is mounted to a cathode ray tube and diminishes the affect to the magnetic field of the corner part of the mask frame and isolates a stream of the earth's magnetic field as the vertical and level elements of the magnetic field when the vertical and level elements of the earth's magnetic field appear in this area.

Namely, because such a structure can improve a degaussing efficiency of the mask frame, changes in the magnetic field can be decreased.

As result of measuring the quantity of the shifting of the electron beam of a mask having a size of 29 inches and made of an aluminum-killed steel to vertical elements 1 gauss of the earth's magnetic field, the quantity of the shifting of beams was 57 mm when resistance holes are not drilled in a corner part of the mask frame, and it was 40 mm in present invention where resistance holes are drilled in a corner part of the mask frame.

And a result of measuring the quantity of the shifting of the electron beams of the mask having a size of 29 inch and made of metal with invar qualities to vertical elements 1 gauss of the earth's magnetic field, the quantity shifting was 42.5 mm when resistance holes are not drilled in a corner part of the mask frame, and it was 21.5 mm in the present invention where resistance holes are drilled in a corner part of the mask frame.

As can be seen through the experiment, if resistance holes are drilled in corner parts of the mask frame, the quantity of change in the magnetic field of the mask frame inner corner part can be decreased compared to that of the prior art.

As a result, this mask frame is able to prevent a decline in the colorimetric the screen corner part resulting from changes in the magnetic field of the mask frame corner part.

What is claimed is:

1. A color cathode ray tube, comprising:

a shadow mask for passing an electron beam to each phosphor disposed on an inside panel of the cathode ray tube; and a mask frame for said shadow mask, said mask frame having long and short sides defining a substantially rectangular frame with four corners, and a flange extending inwardly from said substantially rectangular frame in a direction substantially parallel with the inside panel of the cathode ray tube, wherein said substantially rectangular frame comprises a plurality of resistance holes adjacent each of the four corners with a first one of said plurality of holes at each of the four corners being formed in the long wall and a second one of said plurality of holes at each of the four corners being formed in the short wall, and said flange comprises a hole adjacent each of the four corners of the substantially rectangular frame.

2. The color cathode ray tube of claim 1 wherein said flange comprises a plurality of holes adjacent each of the four corners of the substantially rectangular frame.

3. A mask frame for a shadow mask of a cathode ray tube comprising two sets of opposing walls joined by corners to form a substantially rectangular frame with four corners, and a flange extending inwardly from said substantially rectangular frame, wherein said substantially rectangular frame comprises a plurality of resistance holes adjacent one of the corners to reduce magnetic field variations, and said flange comprises a resistance hole adjacent said one of the corners of said substantially rectangular frame.

4. The mask frame of claim 3 wherein said substantially rectangular frame further comprises a plurality of resistance holes adjacent each of the four corners, and said flange comprises a hole adjacent each of the four corners of said substantially rectangular frame.

5. The mask frame of claim 4 wherein said flange comprises a plurality of holes adjacent each of the four corners of said substantially rectangular frame.

6. The mask frame of claim 3 wherein said flange comprises a plurality of holes adjacent said one of the corners of said substantially rectangular frame.

* * * * *